US009891021B2

(12) United States Patent
Galoob

(10) Patent No.: US 9,891,021 B2
(45) Date of Patent: Feb. 13, 2018

(54) HANDGUN CARRIER

(71) Applicant: The Texas Girdle Concealed Carry System, Inc., Crowley, TX (US)

(72) Inventor: Mark Galoob, Crowley, TX (US)

(73) Assignee: The Texas Girdle Concealed Carry System, Inc., Crowley, TX (US)

( * ) Notice: Subject to any disclaimer, the term of this patent is extended or adjusted under 35 U.S.C. 154(b) by 0 days.

(21) Appl. No.: 14/473,064

(22) Filed: Aug. 29, 2014

(65) Prior Publication Data

US 2015/0233670 A1 Aug. 20, 2015

Related U.S. Application Data

(60) Provisional application No. 61/940,075, filed on Feb. 14, 2014.

(51) Int. Cl.
*F41C 33/02* (2006.01)
*F41C 33/04* (2006.01)

(52) U.S. Cl.
CPC ..... *F41C 33/0236* (2013.01); *F41C 33/046* (2013.01); *F41C 33/048* (2013.01)

(58) Field of Classification Search
CPC .... F41C 33/048; F41C 33/02; F41C 33/0209; F41C 33/0218; F41C 33/0227; F41C 33/0236; F41C 33/0245; F41C 33/0254; F41C 33/0263; F41C 33/0272; F41C 33/04; F41C 33/041; F41C 33/043; F41C 33/045; F41C 33/046
USPC ..... 224/192–193, 198, 238, 243–244, 907, 224/911–912
See application file for complete search history.

(56) References Cited

U.S. PATENT DOCUMENTS 4,094,450 A * 6/1978 Parlante ..... F41C 33/0263 224/243
4,286,741 A 9/1981 Rogers
4,395,837 A * 8/1983 Durnal ..... F41A 17/54 42/70.11
4,579,265 A * 4/1986 Schiller ..... A45C 1/04 224/222
5,150,475 A * 9/1992 Hansen ..... A41D 13/088 2/16
5,161,721 A 11/1992 Nichols
5,544,794 A 8/1996 Nichols
5,894,976 A * 4/1999 Harper ..... A45F 5/00 224/198
5,909,834 A 6/1999 Parrott, III
6,402,001 B1 6/2002 Madarang
6,695,186 B2 2/2004 Madarang
6,814,270 B2 11/2004 Mason
(Continued)

*Primary Examiner* — Scott McNurlen
(74) *Attorney, Agent, or Firm* — Scott T. Griggs; Griggs Bergen LLP

(57) ABSTRACT

A handgun carrier for carrying a handgun is disclosed. In one embodiment, a flexible band encircles the torso and comfortably fit thereagainst with complimentary fasteners adjustably securing the ends of the flexible band. A U-shaped receiver is coupled to the flexible band and configured to permit the handgun to be drawn and holstered from the U-shaped receiver by a bearer of the handgun moving the handgun in a general vertical direction. The U-shaped receiver provides point-of-contact support of the handgun, including front strap and slide subjacent support contact and adjacent grip panel support.

11 Claims, 3 Drawing Sheets

(56) References Cited

U.S. PATENT DOCUMENTS

| | | | | |
|---|---|---|---|---|
| 7,258,259 | B1 | 8/2007 | Owens | |
| 7,631,368 | B1 | 12/2009 | Samson | |
| D657,951 | S * | 4/2012 | Davis | D3/222 |
| D658,364 | S * | 5/2012 | Davis | D3/222 |
| 8,622,269 | B2 | 1/2014 | Hogue | |
| 2011/0226825 | A1* | 9/2011 | Sanford | F41C 33/048 224/243 |
| 2012/0085802 | A1 | 4/2012 | Ferrante | |
| 2013/0015225 | A1 | 1/2013 | Hogue | |
| 2013/0180144 | A1 | 7/2013 | Kresser et al. | |
| 2014/0158734 | A1* | 6/2014 | Bickert | F41C 33/048 224/587 |

* cited by examiner

HANDGUN CARRIER

PRIORITY STATEMENT AND CROSS REFERENCE TO RELATED APPLICATIONS

This application claims priority from patent application U.S. Patent Application Ser. No. 61/940,075 entitled "Handgun Carrier" and filed on Feb. 14, 2014 in the name of Mark Galoob; which is hereby incorporated by reference for all purposes.

TECHNICAL FIELD OF THE INVENTION

This invention relates, in general, to handgun carriers and, in particular, to handgun carriers for carrying a handgun in concealment wherein the means to enclose the carried article, i.e., the handgun, is constructed or arranged on the body to hide the handgun.

BACKGROUND OF THE INVENTION

Many individuals who carry a handgun regularly find it a challenge to find a concealed handgun carrier that combines adequate comfort, concealment, and functionality. Too many times, everything is a trade-off and comfort must be sacrificed for concealment or concealment sacrificed for functionality, etc. Advances in the art of carrying a handgun in concealment are required to provide the comfort, concealment, and functionality bearers of concealed handguns desire.

SUMMARY OF THE INVENTION

It would be advantageous to achieve advances in the art of carrying a handgun in order to improve concealment. It would also be desirable to enable a mechanical solution that would improve comfort and functionality for bearers of concealed handguns. To better address one or more of these concerns, a handgun carrier is disclosed. In one embodiment of the handgun carrier, a flexible band encircles the torso and comfortably fits thereagainst with complimentary fasteners adjustably securing the ends of the flexible band. A U-shaped receiver is coupled to the flexible band and configured to permit the handgun to be drawn and holstered from the U-shaped receiver by a bearer of the handgun moving the handgun in a general vertical direction. The U-shaped receiver provides point-of-contact support of the handgun, including front strap and slide subjacent support contact and adjacent grip panel support. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
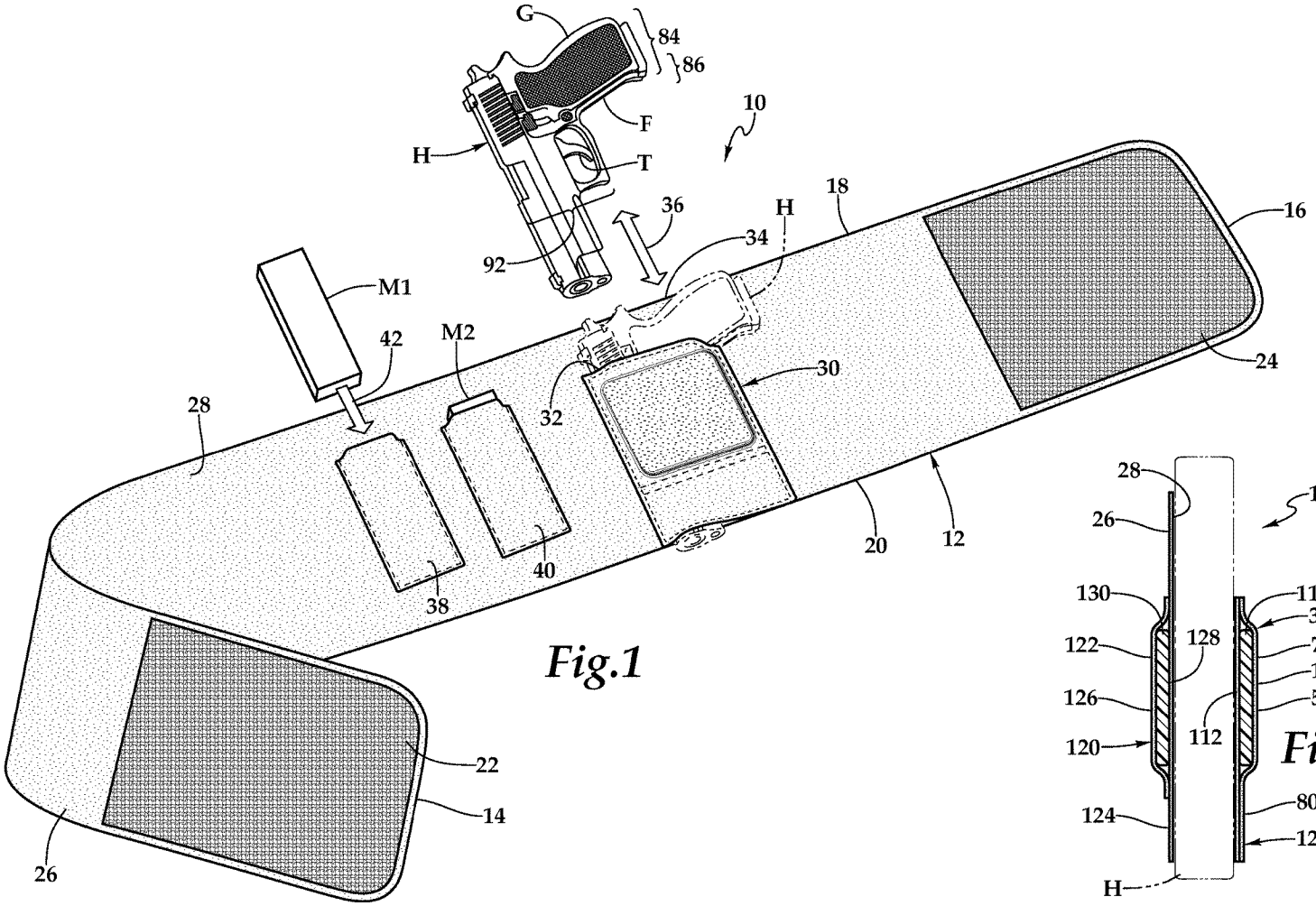
FIG. 1 is a front perspective view of one embodiment of the handgun carrier that may be utilized by an individual carrying a handgun.
Figure 10:
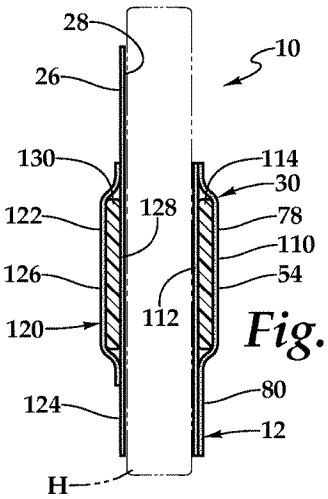
FIG. 10 is a side cross-sectional view of a portion of the handgun carrier depicted in FIG. 1 as viewed along line 10-10 of FIG. 4, wherein the handgun is depicted in dashed lines.
Figure 2:
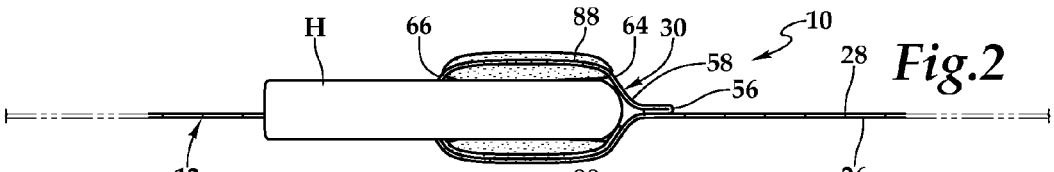
FIG. 2 is a top plan view of a portion of the handgun carrier depicted in FIG. 1, wherein a handgun is holstered therein.
Figure 3:
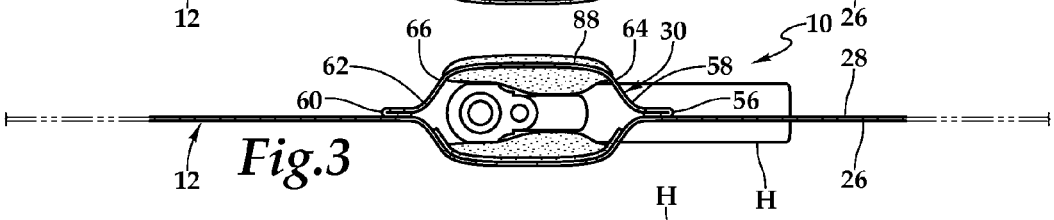
FIG. 3 is a bottom plan view of a portion of the handgun carrier depicted in FIG. 1, wherein a handgun is holstered therein.
Figure 4:
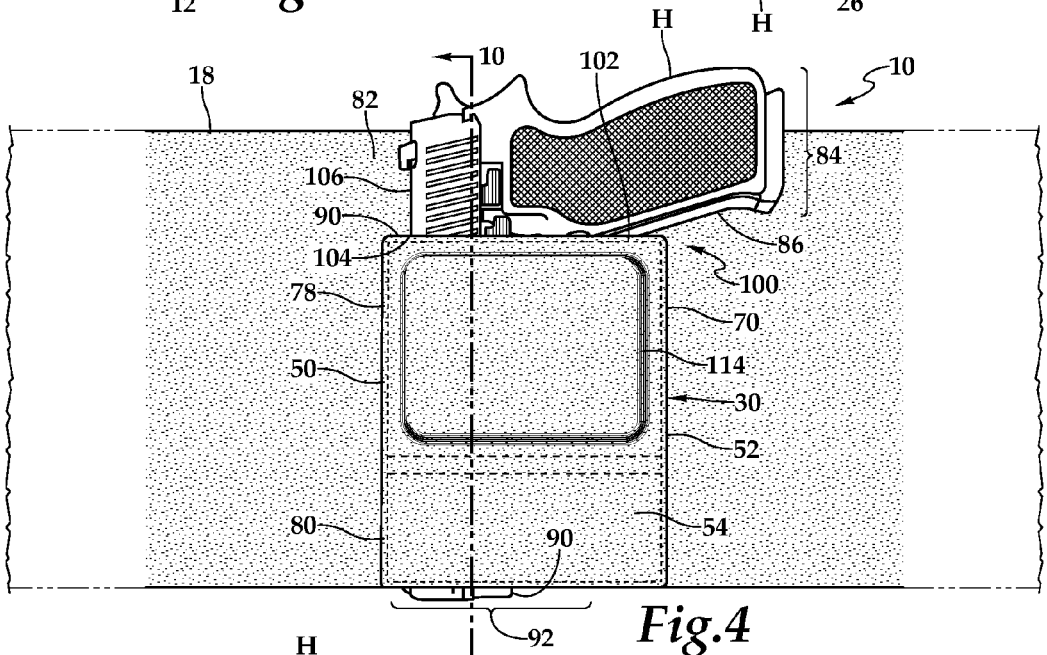
FIG. 4 is a front elevation view of a portion of the handgun carrier depicted in FIG. 1, wherein a handgun is holstered therein.
Figure 5:
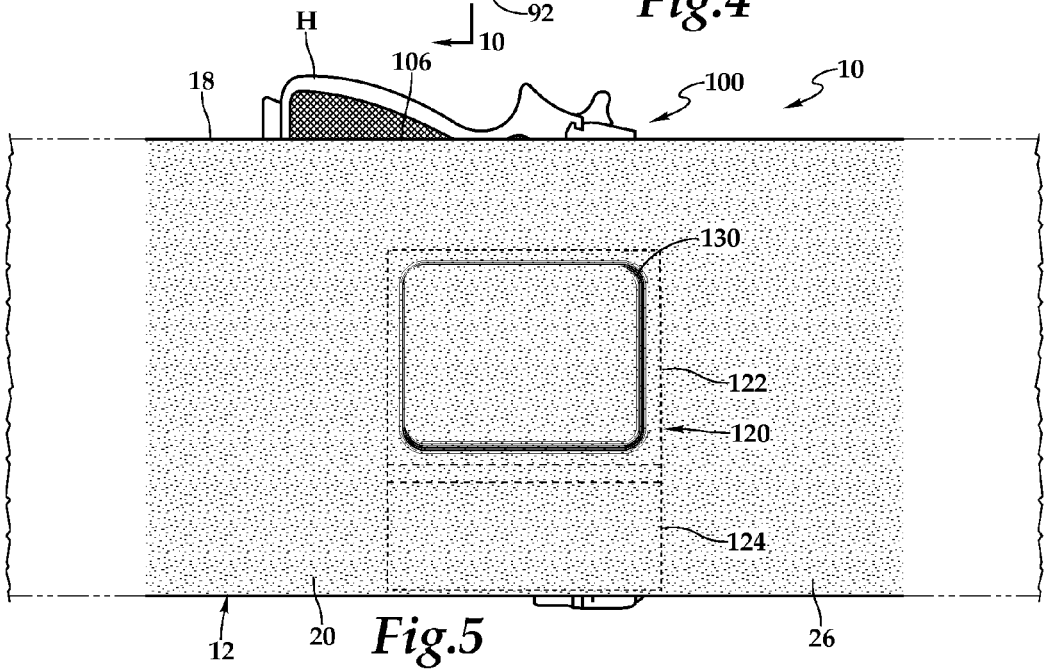
FIG. 5 is a rear elevation view of a portion of the handgun carrier depicted in FIG. 1, wherein a handgun is holstered therein.
Figure 6:
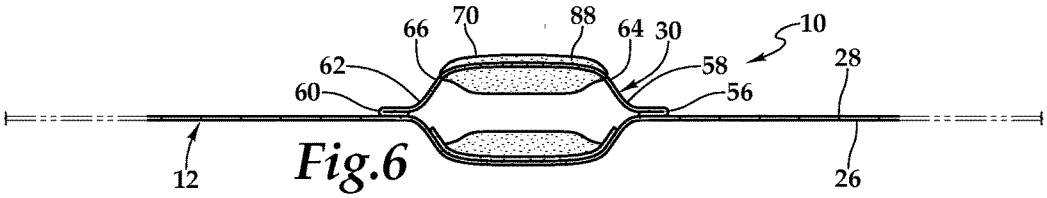
FIG. 6 is a top plan view of a portion of the handgun carrier depicted in FIG. 1.
Figure 7:
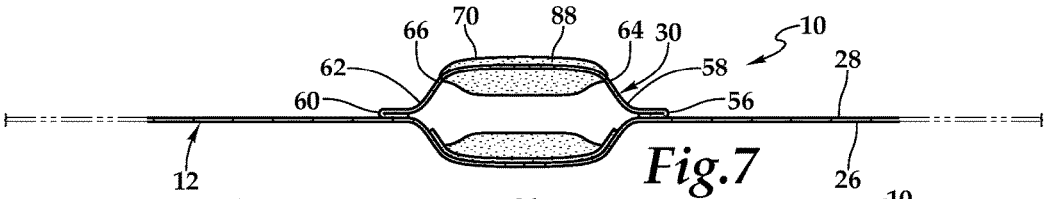
FIG. 7 is a bottom plan view of a portion of the handgun carrier depicted in FIG. 1.
Figure 8:
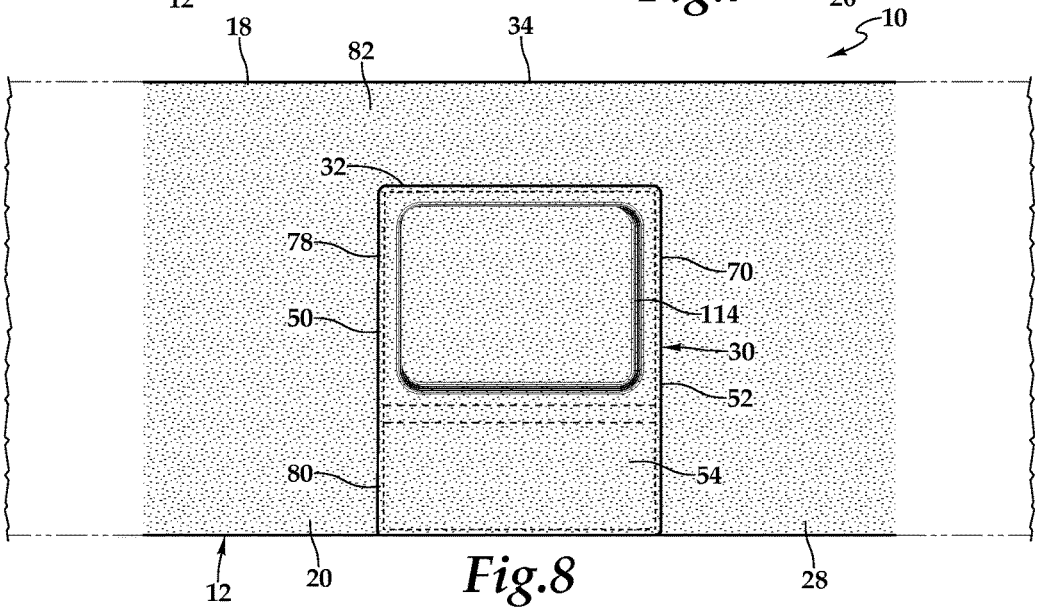
FIG. 8 is a front elevation view of a portion of the handgun carrier depicted in FIG. 1.
Figure 9:
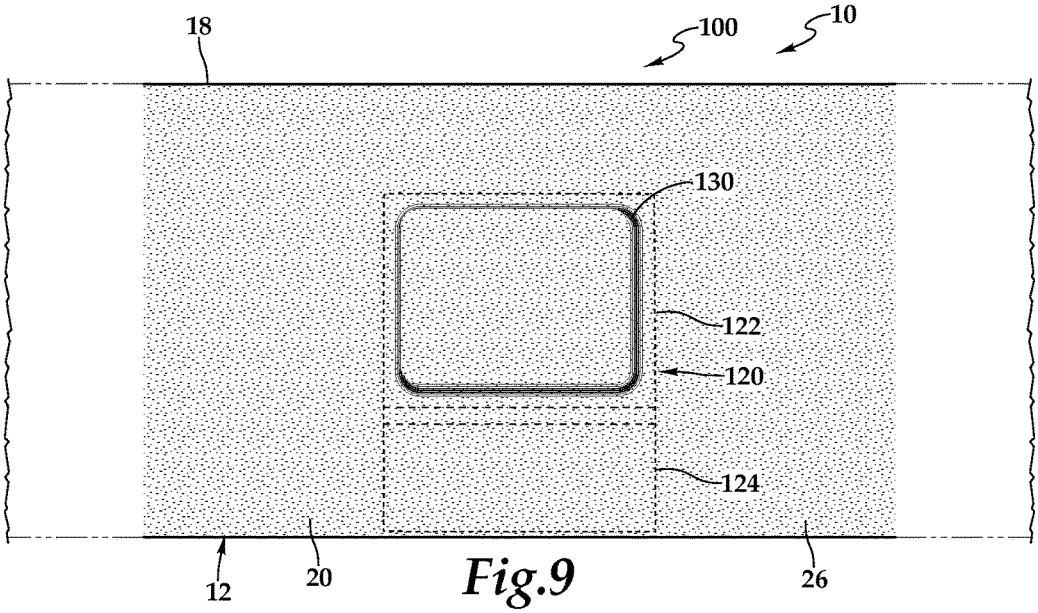
FIG. 9 is a rear elevation view of a portion of the handgun carrier depicted in FIG. 1.

Referring to FIG. 1, therein is depicted one embodiment of a handgun carrier that is schematically illustrated and generally designated 10. A bearer having a handgun H may utilize the illustrated handgun carrier 10 to carry the handgun H around the torso. As explained in further detail below, the handgun carrier provides comfort, concealment, and functionality that bearers of concealed handguns desire. It should be appreciated however, although the handgun carrier 10 is depicted as fitting the torso, the handgun carrier 10 may be appropriately sized to fit other parts of the body of the bearer, including the wrist, thigh, or ankle, for example.

With respect to the handgun carrier 10, a flexible band 12 includes ends 14, 16 and an upper edge 18 and a lower edge 20. As discussed, the flexible band 12 is configured to encircle a portion of the body of a bearer of the handgun and comfortably fit thereagainst. Complimentary fasteners 22, 24, which in the illustrated embodiment are depicted as fabric hook and loop fasteners, are respectively coupled to the ends 14, 16 and configured to selectively and adjustably secure the ends 14, 16 to each other. As shown, the flexible band 12 includes an interior side 26 and an exterior side 28, with the interior side 26 being pressed against the body. The fastener 22 may be affixed to the interior side 26 and the fastener 24 may be affixed to the exterior side 28.

A U-shaped receiver 30 is coupled to the exterior side 28 of the flexible band 12 between the upper edge 18 and the lower edge 20. The U-shaped receiver 30 is configured to permit the handgun H to be drawn and holstered from the U-shaped receiver 30 by a bearer of the handgun H moving the handgun H in a general vertical direction via a vertical window 32 and a horizontal window 34 as shown by double-headed arrow 36. It should be appreciated that the direction the handgun H will be moved to draw or holster depends on the orientation of the handgun carrier 10, which depends on the position of the bearer and the portion of the body the handgun carrier is intended to fit. More generally, the vertical window 32 may be considered a y-axis window 32 and the horizontal window, an x-axis window 34.

In one embodiment, the handgun carrier 10 has a symmetrical configuration including left/right symmetry that enables the handgun H to be carried each of strong side and cross draw. With this symmetrical configuration, the U-shaped receiver 30 permits the handgun H to be carried on either side of the body, including either side of the torso. Additionally, in one implementation, optional magazine carriers 38, 40 are positioned on the exterior side 28 of the flexible band to provide carrying capacity for magazines, such as magazine M, which may be inserted into magazine carrier 38 as shown by arrow 42. It should be appreciated that although one positioning of the U-shaped receiver 30 on the flexible band 12 is depicted in FIG. 1, depending on the application, the positioning of the U-shaped receiver may vary. The variation in positioning may include the distance the U-shaped receiver 30 is with respect to the upper edge 18 and the lower edge 20 of the flexible band 12.

Referring now to FIGS. 1 through 10, in one embodiment, the U-shaped receiver 26 includes sidewalls 50, 52, 54 respectively including edges 56, 58; edges 60, 62; and edges 64, 66. The sidewalls 50, 52 are vertically extended and spaced apart and coupled edgewise at respective edges 56, 60 to the flexible band 12 such that, in one implementation, the sidewalls 50, 52 are substantially orthogonal to the flexible band 12. The sidewall 54 is horizontally spaced and substantially parallel to the flexible band 12 such that the sidewall 54 traverses a span between the sidewalls 50, 52 by being coupled to respective edges 58, 62 of the sidewalls 50, 52 at edges 64, 66. The sidewalls 50, 52, 54 may form a pocket 70 wherein the sidewalls 50, 52, 54 are integral and continuous. The sidewall 54 includes an upper panel 78 and a lower panel 80 and, in one implementation, the upper panel 78 may be rigid, including a rigid component.

In one implementation, the flexible band includes a vertical support extension portion 82 that begins at the U-shaped receiver 30 and ends at the upper edge 18. As depicted, the vertical support extension portion 82 and the U-shaped receiver 30 provide, in combination, the vertical or y-axis window 32 and the horizontal or x-axis window 34. In one embodiment, the vertical support extension portion 82 includes a vertical dimension less than a pistol grip dimension 84 and a vertical dimension greater than a front strap dimension 86. By providing this spacing arrangement between the U-shaped receiver 30 and the flexible 12 band, a bearer of the handgun H is able to quickly obtain a firm grip appropriate for drawing the handgun H. Moreover, space is provided that ensures the grip and action portions of the handgun H minimally adversely affect comfort during wear.

The U-shaped receiver 30 may include an elastic material 88 that is configured to form an interference fit 90 with the handgun H in order to ensure secure storage and carrying thereof. In the illustrated embodiment, the elastic material 88 include a horizontal dimension commensurate with a trigger guard-to-barrel dimension 92. A point-of-contact configuration 100 provides subjacent contact support 102 between the U-shape receiver 30 and the front strap F of the handgun H. Additionally, adjacent contact support 104 between the slide S and the U-shaped receiver 30 is provided. Moreover, the point-of-contact configuration 100 provides contact support 106 between the grip panel G and vertical support extension portion 82.

As previously alluded, in one embodiment, the upper panel 78 of the sidewall 54 includes an exterior panel 110, an interior panel 112, and a rigid body 114 interposed therebetween. Similarly, in one embodiment, the flexible band 12 includes an interior safety panel 120 having an upper portion 122 and a lower portion 124. The upper portion 122 has an exterior panel 126, an interior panel 128, and a rigid body 130 interposed therebetween. In this implementation, the interior safety panel 120 is complimentarily positioned across from the upper panel 78 of the sidewall 54. The rigid bodies 114, 130 cooperate to mitigate the risk of an accidental discharge of the handgun by being sized and positioned to provide a rigid panel between the external environment and the trigger T of the handgun H.

The order of execution or performance of the methods and operational flows illustrated and described herein is not essential, unless otherwise specified. That is, elements of the methods and operational flows may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A handgun carrier for carrying a handgun, the handgun carrier comprising:

a flexible band having first and second ends and an upper edge and a lower edge, the flexible band configured to encircle a portion of the body of a bearer of the handgun and comfortably fit thereagainst;

first and second complimentary fasteners respectively coupled to the first and second ends, the first and second complimentary fasteners configured to selectively and adjustably secure the first end to the second end;

a U-shaped receiver coupled to the flexible band between the upper edge and the lower edge, the U-shaped receiver including first, second, and third sidewalls, the U-shaped receiver being strapless, the U-shaped receiver being of vertical position and non-angled on the flexible band;

the first and second sidewalls being vertically extended and spaced apart and coupled edgewise at respective first edges to the flexible band, the first and second sidewalls extending at an angle to the flexible band;

the third sidewall being horizontally spaced and parallel to the flexible band, the third sidewall traversing a span between the first and second sidewalls and being coupled to respective second edges of the first and second sidewalls;

the third sidewall including an upper panel and a lower panel, the upper panel being above the lower panel, the upper panel including a first rigid body, the lower panel being of a flexible material;

the flexible band including a vertical support extension portion, the vertical support extension portion beginning at the U-shaped receiver and ending at the upper edge, the vertical support extension portion and U-shaped receiver providing, in combination, a vertical window and a horizontal window;

the flexible band including an interior safety panel having an upper portion and a lower portion, the upper portion being above the lower portion, the upper portion having an exterior panel, an interior panel, and a second rigid body interposed therebetween, and the upper portion of the interior safety panel being positioned coincidentally across from the upper panel of the third sidewall such that the first rigid body is coincidentally across from the second rigid body, and the first rigid body and the second rigid body are each offset toward an upper edge of the third sidewall and toward the upper edge of the flexible band, respectively;

the U-shaped receiver configured to permit the handgun to be drawn and holstered from the U-shaped receiver by a bearer of the handgun moving the handgun in a vertical direction via the vertical window and the horizontal window;

the U-shaped receiver having a symmetrical configuration including left/right symmetry, the symmetrical configuration providing the handgun to be carried each of strong side and cross draw, the U-shaped receiver configured to permit the handgun to be carried on either side of the torso, the U-shaped receiver configured to provide non-angle draw; and a point-of-contact configuration providing U-shape receiver to front strap subjacent support, the point-of-contact configuration providing U-shape receiver to slide adjacent support contact, the point-of-contact configuration providing grip panel and vertical support extension portion adjacent contact.

2. The handgun carrier as recited in claim 1, wherein the vertical support extension portion comprises a vertical dimension less than a pistol grip dimension.

3. The handgun carrier as recited in claim 1, wherein the vertical support extension portion comprises a vertical dimension greater than a front strap dimension.

4. The handgun carrier as recited in claim 1, further comprising the vertical support extension portion being integral with the flexible band.

5. The handgun carrier as recited in claim 1, further comprising the portion of the body of the bearer of the handgun being selected from the group consisting of a torso, a thigh, a wrist, and an ankle.

6. The handgun carrier as recited in claim 1, further comprising the flexible band and first and second complimentary fasteners being sized for the portion of the body of the bearer selected from the group consisting of a torso, a thigh, a wrist, and an ankle.

7. The handgun carrier as recited in claim 1, wherein the upper panel of the third sidewall further comprises an exterior panel, an interior panel, and the first rigid body interposed therebetween.

8. The handgun carrier as recited in claim 1, wherein the U-shaped receiver comprises an elastic material configured to form an interference fit with the handgun, the elastic material comprising a horizontal dimension of a trigger guard-to-barrel dimension.

9. The handgun carrier as recited in claim 1, wherein the U-shaped receiver further comprises a pocket wherein the first, second, and third sidewalls are integral and continuous.

10. A handgun carrier for carrying a handgun, the handgun carrier comprising:

a flexible band having first and second ends and an upper edge and a lower edge, the flexible band configured to encircle a portion of the body of a bearer of the handgun and comfortably fit thereagainst;

first and second complimentary fasteners respectively coupled to the first and second ends, the first and second complimentary fasteners configured to selectively and adjustably secure the first end to the second end;

a U-shaped receiver coupled to the flexible band between the upper edge and the lower edge, the U-shaped receiver including first, second, and third sidewalls, the U-shaped receiver being strapless, the U-shaped receiver being of vertical position and non-angled on the flexible band;

the first and second sidewalls being vertically extended and spaced apart and coupled edgewise at respective first edges to the flexible band, the first and second sidewalls extending at an angle to the flexible band;

the third sidewall being horizontally spaced and parallel to the flexible band, the third sidewall traversing a span between the first and second sidewalls and being coupled to respective second edges of the first and second sidewalls;

the third sidewall including an upper panel and a lower panel, the upper panel being above the lower panel the upper panel including a first rigid body, the lower panel being of a flexible material;

the flexible band including a vertical support extension portion, the vertical support extension portion beginning at the U-shaped receiver and ending at the upper edge, the vertical support extension portion and U-shaped receiver providing, in combination, a vertical window and a horizontal window;

the flexible band including an interior safety panel having an upper portion and a lower portion, the upper portion being above the lower portion, the upper portion having an exterior panel, an interior panel, and a second rigid body interposed therebetween, and the upper portion of the interior safety panel being positioned coincidentally across from the upper panel of the third sidewall such that the first rigid body is coincidentally across from the second rigid body, and the first rigid body and the second rigid body are each offset toward an upper edge of the third sidewall and toward the upper edge of the flexible band, respectively;

the vertical support extension portion including a vertical dimension less than a pistol grip dimension and greater than a front strap dimension;

the U-shaped receiver configured to permit the handgun to be drawn and holstered from the U-shaped receiver by a bearer of the handgun moving the handgun in a vertical direction via the vertical window and the horizontal window;

the U-shaped receiver having a symmetrical configuration including left/right symmetry, the symmetrical configuration providing the handgun to be carried each of strong side and cross draw, the U-shaped receiver configured to permit the handgun to be carried on either side of the torso, the U-shaped receiver configured to provide non-angle draw; and a point-of-contact configuration providing U-shape receiver to front strap subjacent support, the point-of-contact configuration providing U-shape receiver to slide adjacent support contact, the point-of-contact configuration providing grip panel and vertical support extension portion adjacent contact.

11. A handgun carrier for carrying a handgun, the handgun carrier comprising:

a flexible band having first and second ends and an upper edge and a lower edge, the flexible band configured to encircle a portion of the body of a bearer of the handgun and comfortably fit thereagainst;

first and second complimentary fasteners respectively coupled to the first and second ends, the first and second complimentary fasteners configured to selectively and adjustably secure the first end to the second end;

a U-shaped receiver coupled to the flexible band between the upper edge and the lower edge, the U-shaped receiver including first, second, and third sidewalls, the U-shaped receiver being strapless, the U-shaped receiver being of vertical position and non-angled on the flexible band;

the first and second sidewalls being vertically extended and spaced apart and coupled edgewise at respective first edges to the flexible band, the first and second sidewalls extending at an angle to the flexible band;

the third sidewall being horizontally spaced and parallel to the flexible band, the third sidewall traversing a span between the first and second sidewalls and being coupled to respective second edges of the first and second sidewalls;

the third sidewall including an upper panel and a lower panel, the upper panel being above the lower panel the upper panel including a first rigid body;

the flexible band including a vertical support extension portion, the vertical support extension portion beginning at the U-shaped receiver and ending at the upper edge, the vertical support extension portion and U-shaped receiver providing, in combination, a vertical window and a horizontal window;

the vertical support extension portion including a vertical dimension less than a pistol grip dimension and greater than a front strap dimension;

the U-shaped receiver including an elastic material configured to form an interference fit with the handgun, the elastic material comprising a horizontal dimension of a trigger guard-to-barrel dimension;

the U-shaped receiver configured to permit the handgun to be drawn and holstered from the U-shaped receiver by a bearer of the handgun moving the handgun in a vertical direction via the vertical window and the horizontal window;

the U-shaped receiver having a symmetrical configuration including left/right symmetry, the symmetrical configuration providing the handgun to be carried each of strong side and cross draw, the U-shaped receiver configured to permit the handgun to be carried on either side of the torso, the U-shaped receiver configured to provide non-angle draw;

a point-of-contact configuration providing U-shape receiver to front strap subjacent support, the point-of-contact configuration providing U-shape receiver to slide adjacent support contact, the point-of-contact configuration providing grip panel and vertical support extension portion adjacent contact; and the flexible band including an interior safety panel having an upper portion and a lower portion, the upper portion being above the lower portion, the upper portion having an exterior panel, an interior panel, and a second rigid body interposed therebetween, and the upper portion of the interior safety panel being positioned across from the upper panel of the third sidewall such that the first rigid body is coincidentally across from the second rigid body, and the first rigid body and the second rigid body are each offset toward an upper edge of the third sidewall and toward the upper edge of the flexible band, respectively.

* * * * *